US006056578A

United States Patent [19]

Lin

[11] Patent Number: 6,056,578

[45] Date of Patent: May 2, 2000

[54] UNIVERSAL SERIAL BUS CONNECTOR

[75] Inventor: C. T. Lin, Taipei, Taiwan

[73] Assignee: Advanced-Connectek, Inc., Taipei, Taiwan

[21] Appl. No.: 09/006,530

[22] Filed: Jan. 13, 1998

[51] Int. Cl.[7] ..... H01R 13/627

[52] U.S. Cl. ..... 439/358; 439/923

[58] Field of Search ..... 439/349–358, 439/923

[56] References Cited

U.S. PATENT DOCUMENTS

| | | | |
|---|---|---|---|
| 3,399,374 | 8/1968 | Pauza et al. | 439/355 |
| 5,340,329 | 8/1994 | Hirai | 439/357 |
| 5,713,752 | 2/1998 | Leong et al. | 439/358 |
| 5,727,963 | 3/1998 | LeMaster | 439/358 |
| 5,775,931 | 7/1998 | Jones | 439/358 |

*Primary Examiner*—Lincoln Donovan
*Attorney, Agent, or Firm*—Dougherty & Troxell

[57] ABSTRACT

A universal serial bus connector including a male and a female connector. The male connector has elastic hooking means fixed to two sides of its casing. The hooking means each has a front hook and an outward projected elastic rear push portion. The female connector has outward extended retaining tabs provided at two edges of its each insertion hole corresponding to the hooks of the hooking means on the male connector. When the male connector is inserted into the female connector with the rear push portions of the hooking means inward pressed, the hooks may be located beyond the retaining tabs on the female connector. When the push portions of the hooking means are released, the hooks of the hooking means elastically shift inward to engage with said retaining tabs and cause the male connector to be firmly connected to the female connector without easily disengaging from the latter.

8 Claims, 11 Drawing Sheets

UNIVERSAL SERIAL BUS CONNECTOR

FIELD OF THE INVENTION

The present invention relates to an improved universal serial bus connector, and more particularly to a universal serial bus connector which includes a male connector provided with elastic hooking means and a female connector provided with retaining means corresponding to the hooking means on the male connector, so that the male connector can be firmly connected to the female connector without disengaging from the latter easily.

DESCRIPTION OF THE PRIOR ART

The use of connectors on computers and many other electronic communication equipment enables not only good transmission of signals, but also quick and flexible connection of various internal and external expansion structure to the electronic equipment. Moreover, the connectors allow us to do communication with a remote place. In brief, the connectors are significantly important in terms of the transmission of electric signals via them.

Among various kinds of connectors, there is a universal serial bus (USB) connector. FIG. 1 illustrates a standard type of such connector. As shown, the USB connector is formed from a male connector 100 and a supplementary female connector 200. The female connector 200 can be adhered to a circuit board 300 and has an insertion hole 201 for receiving an insertion end of the male connector 100. A cable 101 extends from another end of the male connector opposite to the insertion end for outputting or inputting electric signals from or to the circuit board 300 via the female connector 200. Following are some of the drawbacks existing in the above conventional USB connector:

1. The male and the female connectors 100, 200 are connected to one another simply by inserting the male connector 100 into the insertion hole 201 of the female connector 200 to engage with a connecting member 2A in the insertion hole 201. The male connector 100 is retained in the insertion hole 201 only by elastic retaining plates 2B formed near an outer end of the female connector 200 without any other fastening means. The male connector 100 tends to be easily pulled out of the insertion hole 201 and disengage from the female connector 200 when the cable 101 is unexpectedly pulled by someone. The disengaged male and female connectors 100, 200 adversely result in disconnected transmission of electric signals.

2. There is not any specially designed fastening means provided on the male and/or the female connectors 100, 200 to ensure an actual connection between them. An operator might carelessly insert the male connector into the female connector 200 to cause a loose connection between them and accordingly a poor transmission of electric signals.

It is therefore tried by the inventor to develop an improved USB connector to eliminate the above-mentioned drawbacks existing in the conventional USB connectors.

SUMMARY OF THE INVENTION

A primary object of the present invention is to provide an improved USB connector formed from male and female connectors. The male connector is provided at two sides of its casing with elastic hooking means which includes a front hook and an elastically outward projected rear push portion. The female connector is provided at two edges of its each insertion hole with two outward extended retaining tabs corresponding to the hooks on the male connector. Whereby, when the male connector is inserted into the female connector with the push portions of the hooking means depressed, the hooks of the hooking means can be located beyond the retaining tabs of the female connector. When the push portions of the hooking means are released, the hooks elastically shift inward to engage with the retaining tabs and therefore cause the male connector to tightly connect to the female connector. The male connector will not easily disengage from the female connector when the cable extended from the male connector is unexpectedly pulled outward and therefore, the transmission of electric signals is not easily interrupted.

Another object of the present invention is to provide an improved universal serial bus connector of which the male and the female connector are provided on their casing with hooking means and retaining tabs, respectively, to ensure a complete connection of the male connector to the female connector. In the event the male connector is inserted into the female connector without engaging the hooking means on the male connector with the retaining,tabs on the female connector, a failed connection between the male connector and the female connector shall occur. This reminds an operator to always tightly connect the male and the female connectors to ensure a good transmission of electric signals.

BRIEF DESCRIPTION OF THE DRAWINGS

The detailed structure, the applied principle, and the advantages of the present invention can be best understood by referring to the following detailed description of the preferred embodiments and the accompanying drawings, wherein.

DETAILED DESCRIPTION OF THE PREFERRED EMBODIMENTS

Figure 1:
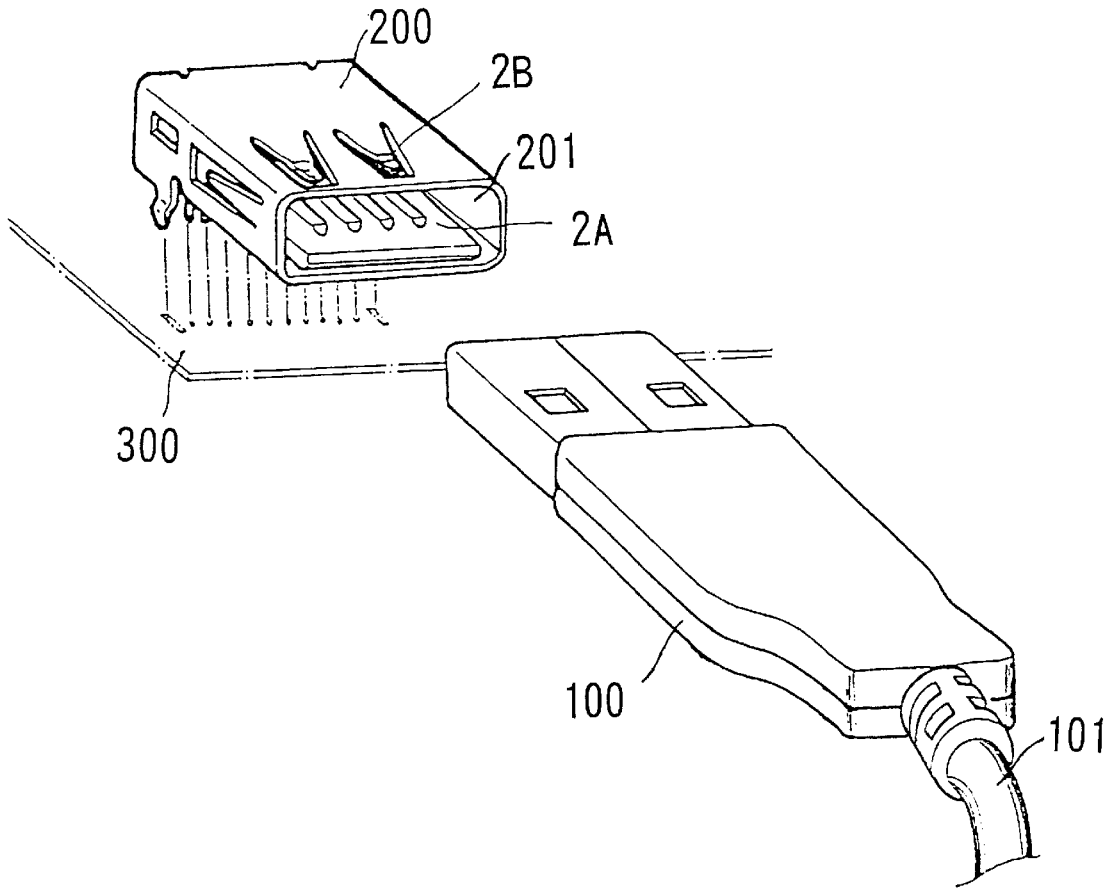
Fig.1 ( PRIOR ART )
FIG. 1 is a perspective view showing a conventional USB connector.
Figure 2:
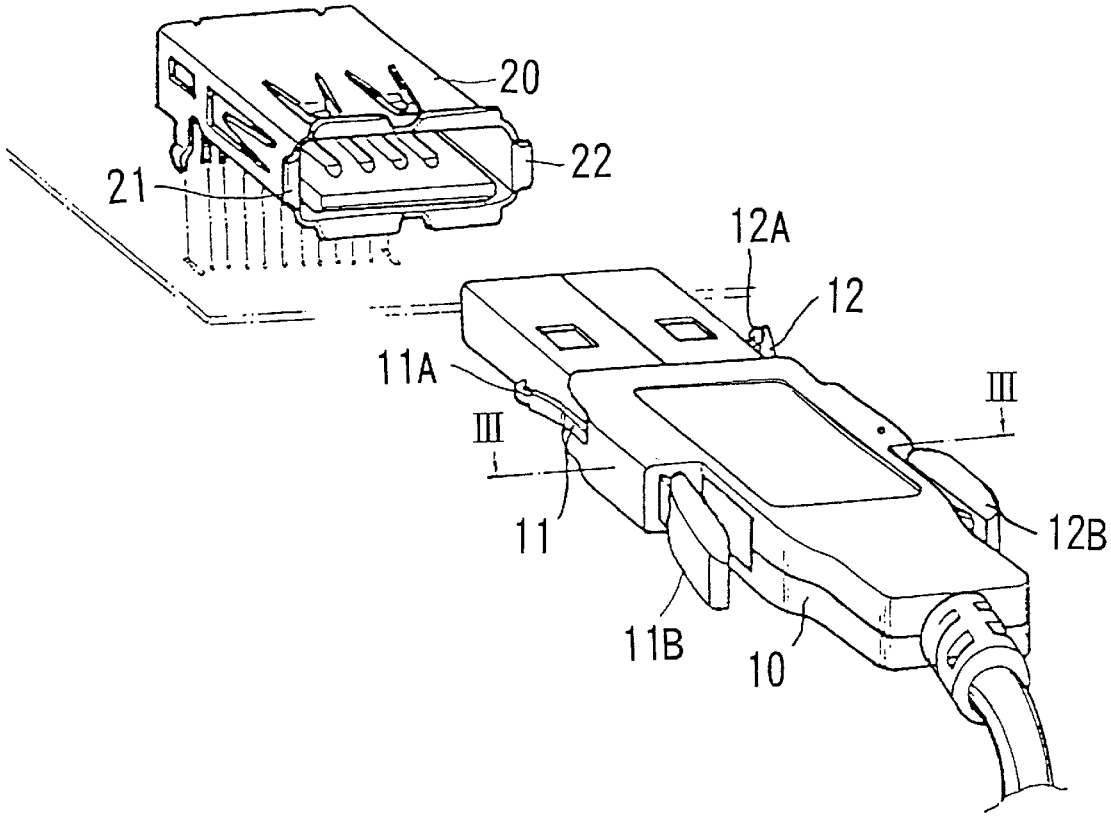
FIG. 2 is a perspective view showing a first embodiment of the USB connector according to the present invention.

Please refer to FIG. 2. The present invention relates to a universal serial bus (USB) connector which mainly includes a male connector 10 and a female connector 20. The male connector 10 is provided at two lateral sides of its casing with two elastic hooking means 11, 12 which have respective hooks 11A, 12A at one end and outward inclined elastic push portions 11B, 12B at the other end. The female connector 20 is provided at two lateral sides of its casing with two outward extended retaining tabs 21, 22 corresponding to the hooks 11A, 12A of the male connector 10. When the male connector 10 is inserted into the female connector 20 with the push portions 11B, 12B of the hooking means 11, 12 pressed toward the casing of the male connector 10, the hooks 11A, 12A are allowed to extend beyond the retaining tabs 21, 22 of the female connector 20 and firmly engage with the retaining tabs 21, 22 when the push portions 11B, 12B are released.

Figure 3A:
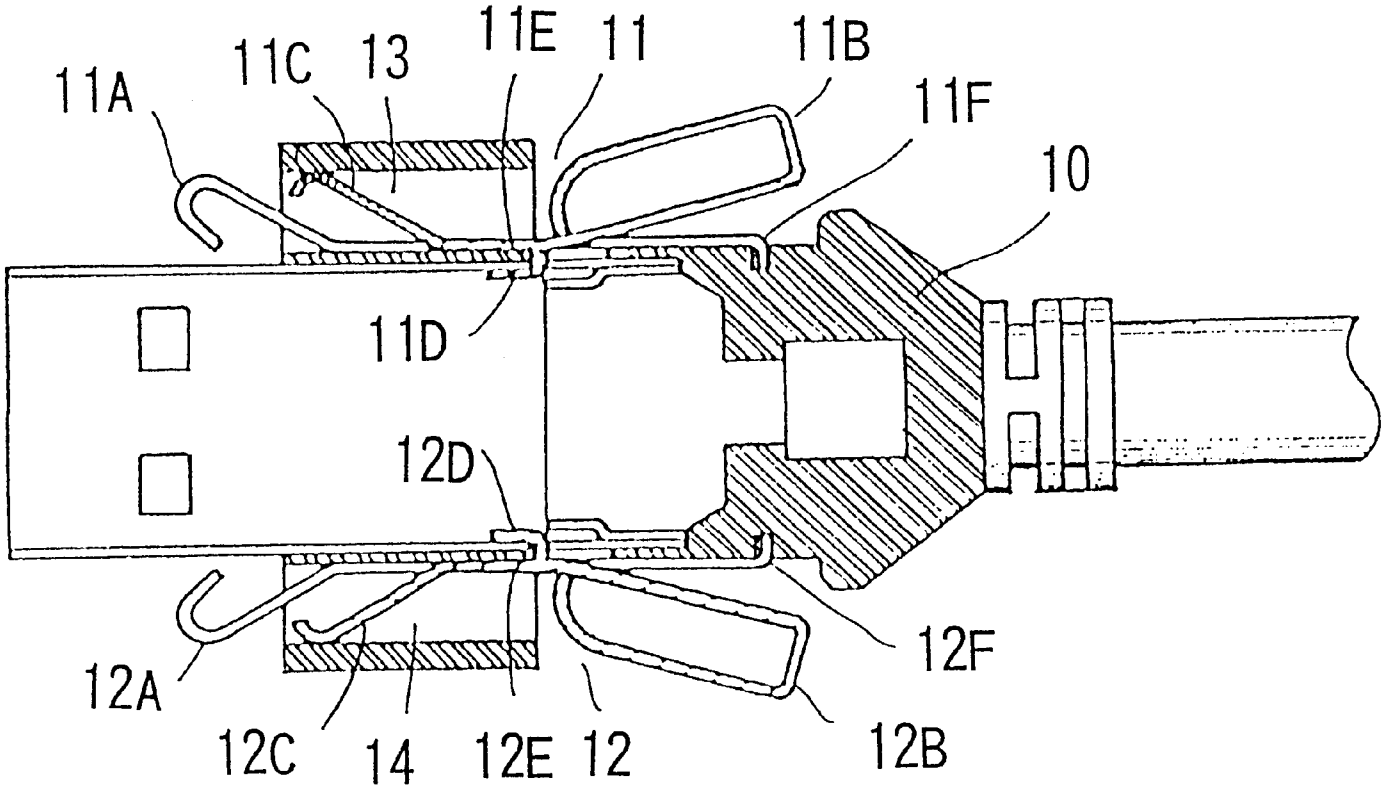
FIG. 3A is a sectional view taken on line III—III of FIG. 2.
Figure 3B:
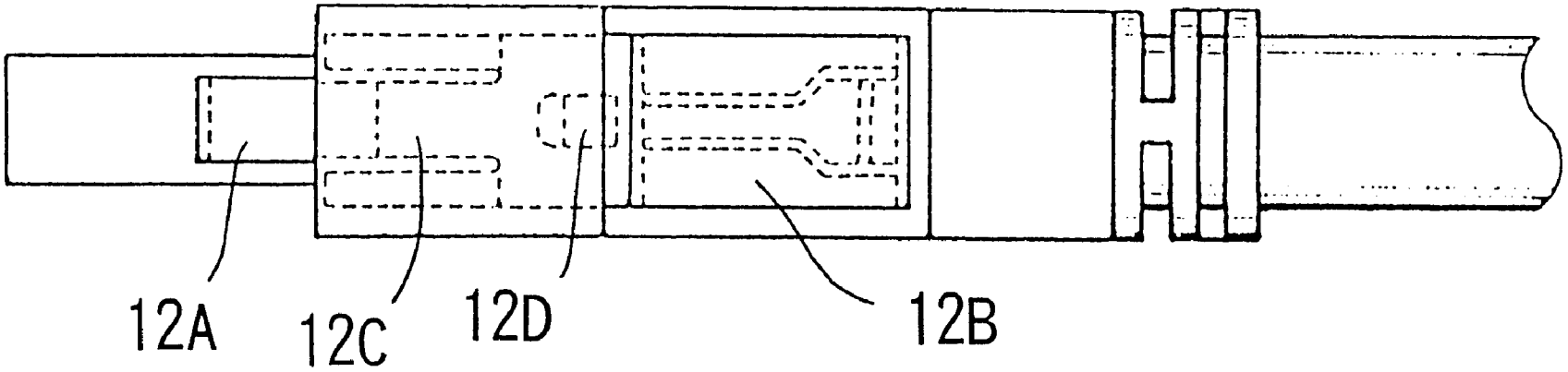
FIG. 3B is a side view of the first embodiment shown in FIG. 2.
Figure 4:
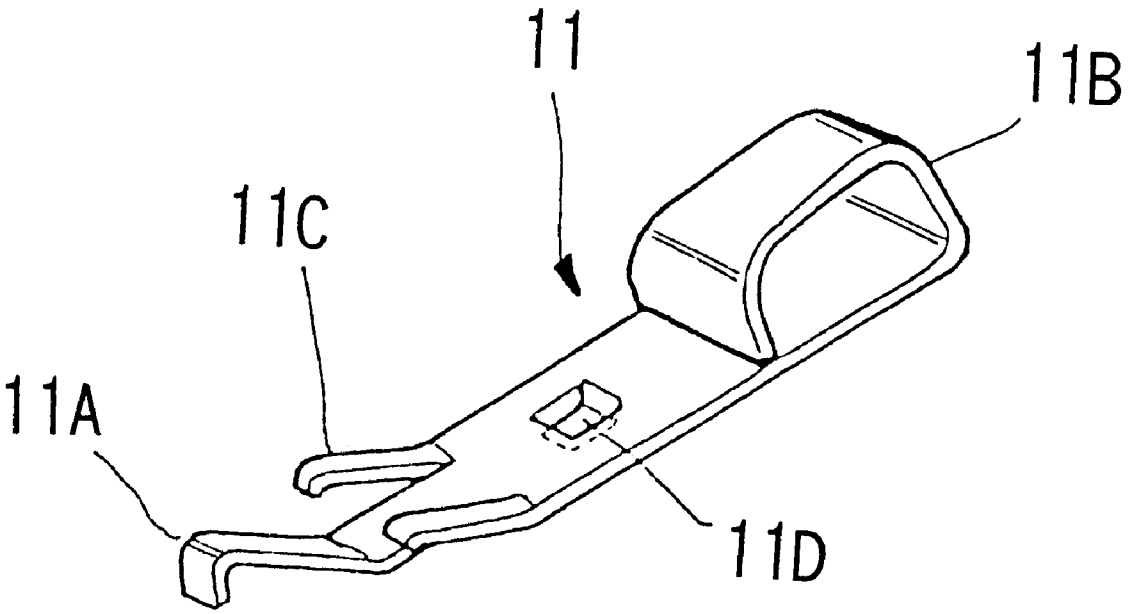
FIG. 4 is a perspective view of the hooking means adopted in the first embodiment of the present invention.

Please refer to FIGS. 3 and 4 at the same time for the detailed structure of the elastic hooking means 11, 12 and their mounting positions relative to the male connector 10. As shown, there are two channels 13, 14 formed at two lateral sides of the casing of the male connector 10. The hooking means 11, 12 are made of elastic plates. In addition to the hooks 11A, 12A and the push portions 11B, 12B, the hooking means 11, 12 respectively have a middle portion, a front end of which, that is, the end of the middle portion facing the female connector 20, forms two outward inclined elastic pressing arms 11C and 12C. Inward extended L-shaped hooks 11D, 12D are formed on the hooking means 11, 12 behind the pressing arms 11C, 12C. The hooking means 11, 12 are mounted on and connected to the male connector 10, such that the L-shaped hook 11D, 12D extend through holes 11E, 12E formed on inner side walls of the channels 13, 14 while the outward inclined elastic pressing arms 11C, 12C press against inner surfaces of outer side walls of the channels 13, 14. The hooking means 11, 12 also have rear retaining portions 11F, 12F which extend into the casing of the male connector 10 to tightly connect the hooking means 11, 12 to the male connector 10 without the risk of disengaging from the male connector 10.

Figure 5:
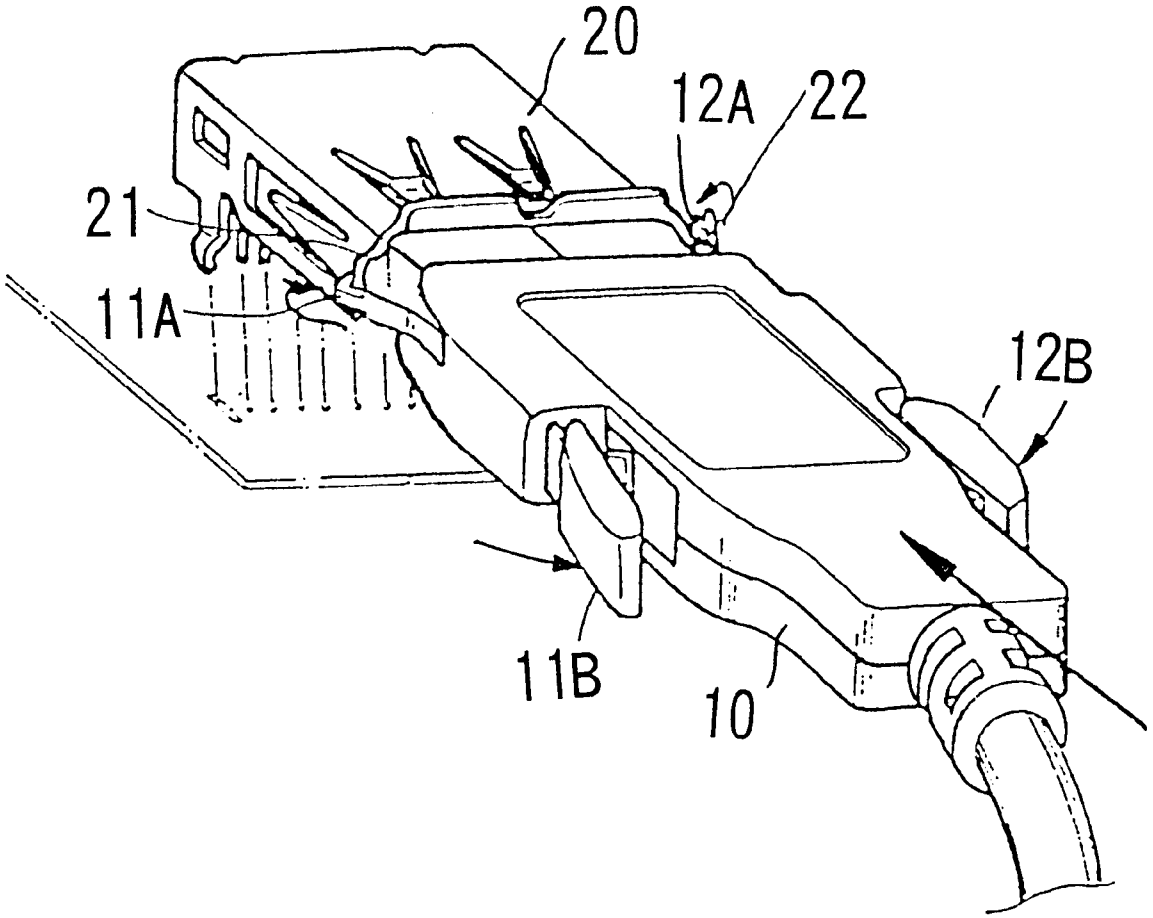
FIG. 5 is a perspective view illustrating the USB connector according to the first embodiment of the present invention with the male and the female connectors thereof in a connected state.

To insert the male connector 10 into the female connector 20, as shown in FIG. 5, an operator may press the push portions 11B, 12B on the male connector 10 to cause the hooks 11A, 12A to move away from the casing of the male connector 10, and then firmly insert the male connector 10 into the female connector 20. When the male connector 10 has been completely inserted into the female connector 20, the hooks 11A, 12A will extend their front ends beyond the retaining tabs 21, 22 on the female connector 20. At this point, releasing of the push portions 11B, 12B will allow the hooks 11A, 12A to move inward and engage with the retaining tabs 21, 22. The engagement of the hooks 11A, 12A with the retaining tabs 21, 22 allows the male connector 10 to be tightly retained in the female connector 20 without the possibility of being easily pulled out of the female connector 20 due to unexpected pulling of the cable extending from the male connector 10.

Figure 6:
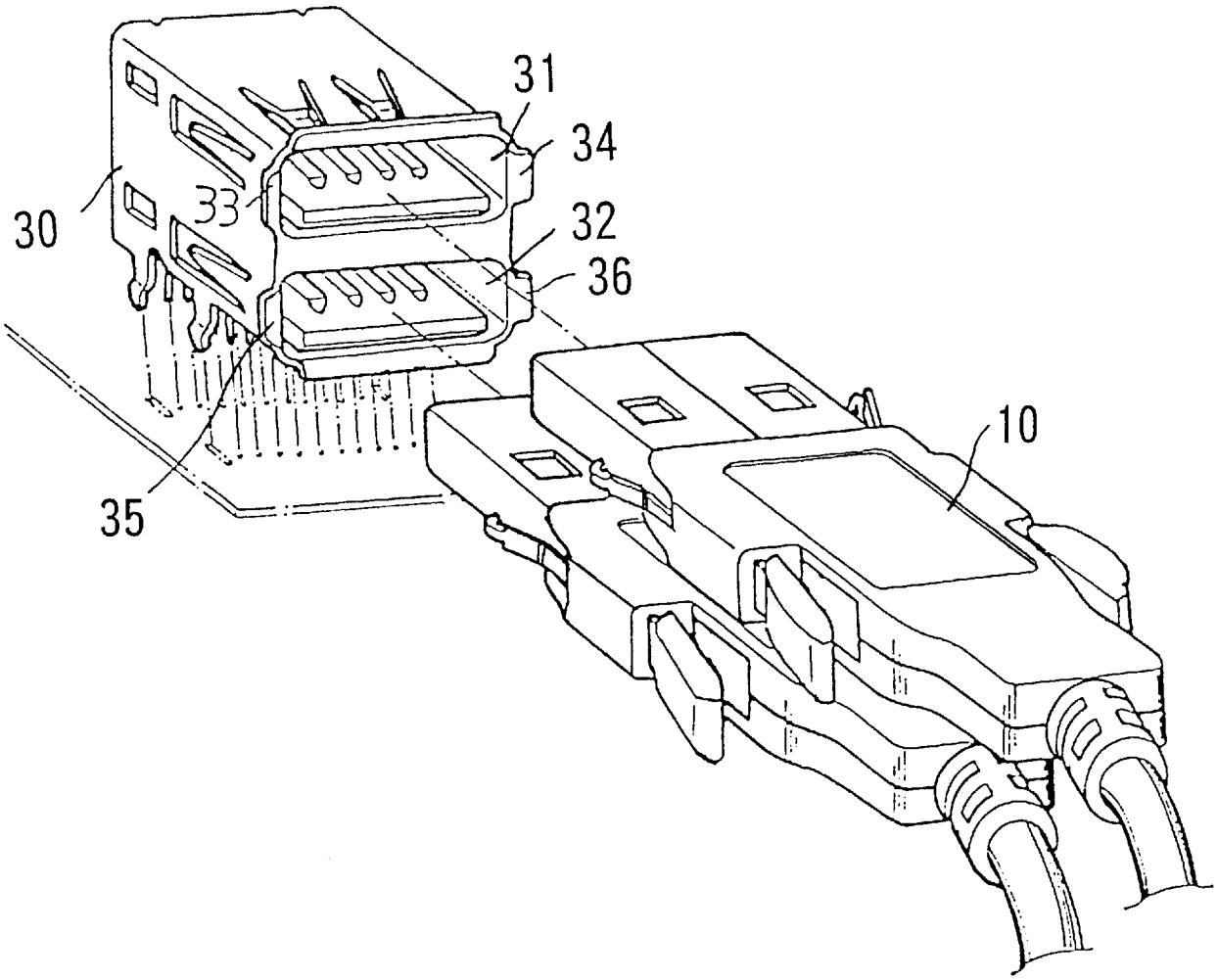
FIG. 6 is a perspective view illustrating a second embodiment of the present invention.

FIG. 6 shows a second embodiment of the present invention. In this embodiment, a female connector 30 formed of more than one insertion hole is used. There are two vertically superposed insertion holes 31, 32 shown in FIG. 6. Both insertion holes 31, 32 are provided at two lateral edges with outward extended retaining tabs 33, 34; 35, 36. With this arrangements, more than one male connector 10 can be parallelly inserted into the female connector 30 at the same time.

Figure 7:
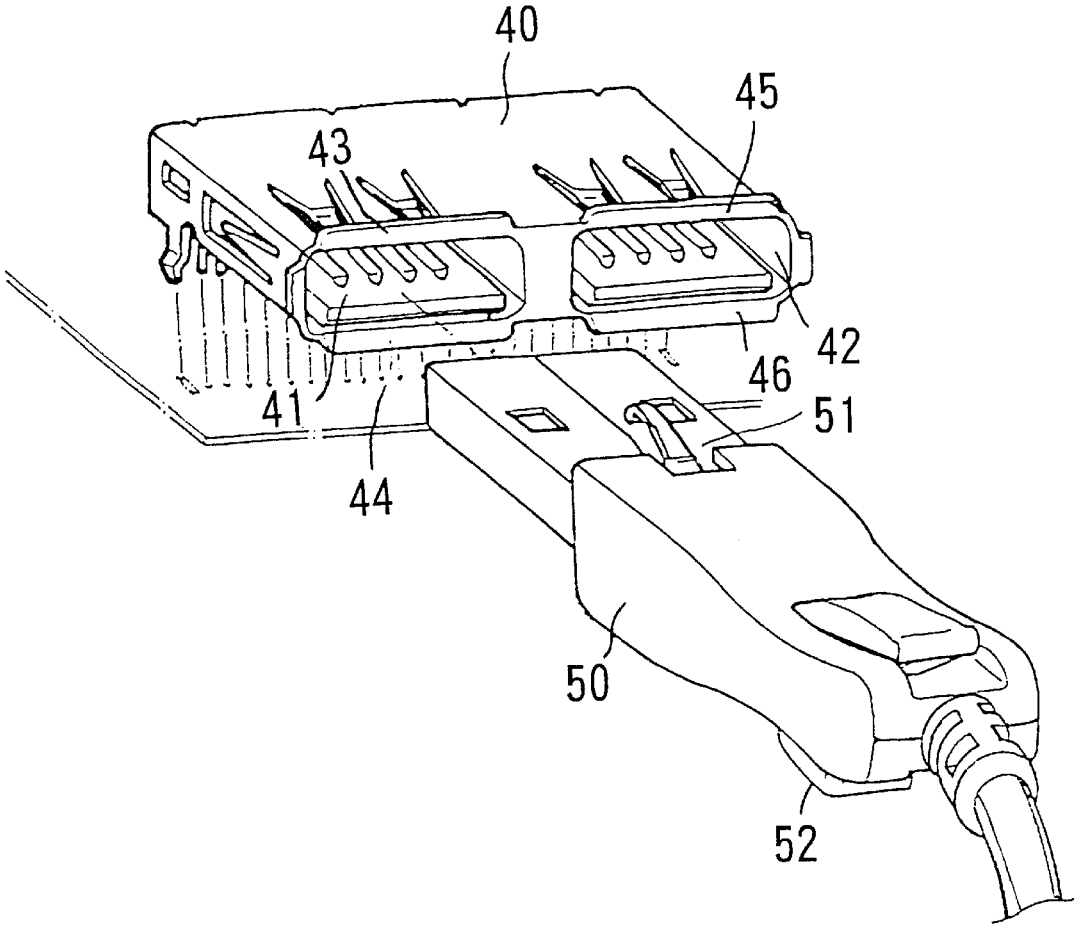
FIG. 7 is a perspective view illustrating a third embodiment of the present invention.

FIG. 7 shows a third embodiment of the present invention. In this embodiment, a female connector 40 formed of more than one insertion hole is used. There are two horizontally arranged parallel insertion holes 41, 42 shown in FIG. 7. Both insertion holes 41, 42 are provided at upper and lower edges with outward extended retaining tabs 43, 44; 45, 46. The male connector 50 used in this embodiment has its elastic hooking means 51, 52 mounted to upper and lower sides of its casing. Similarly, more than one male connector 50 can be inserted into the female connector 40 side by side to increase number of signals to be input or output at the same time.

Figure 8:
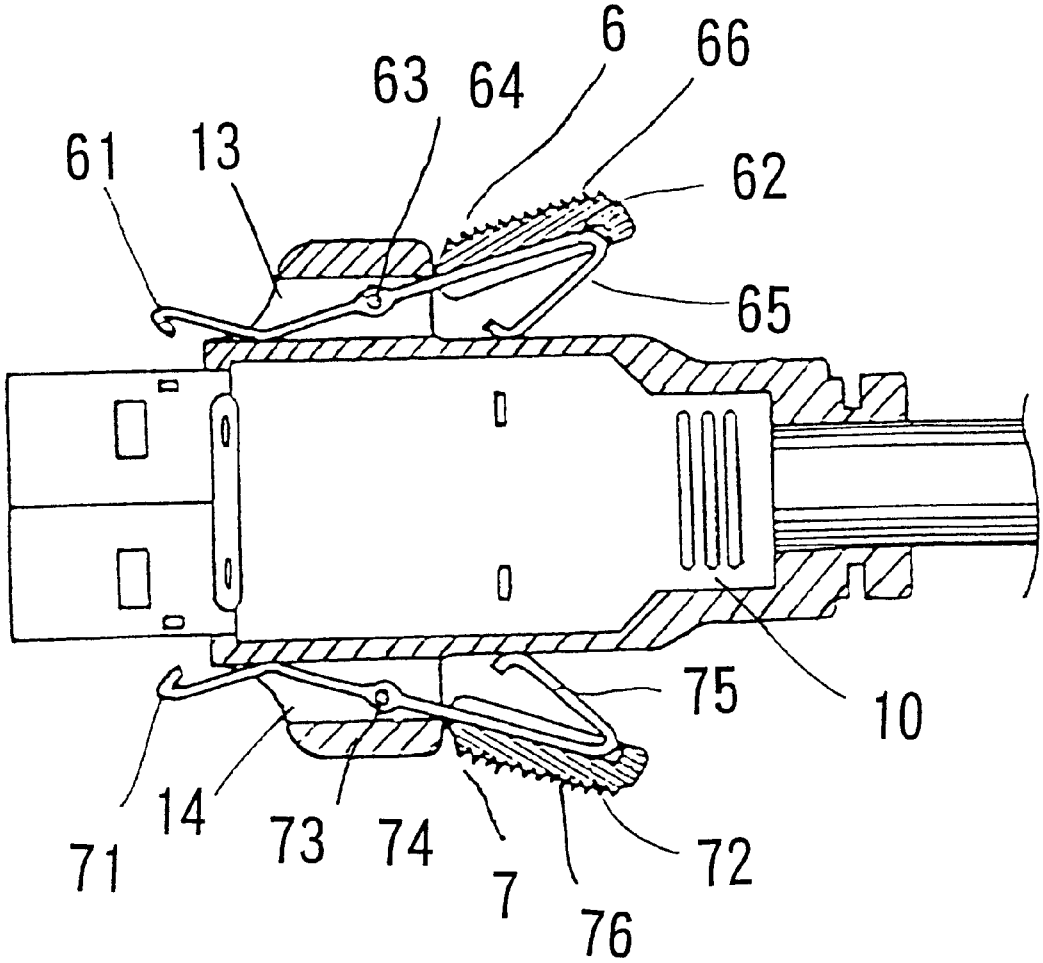
FIG. 8 is a cross-sectional view illustrating another embodiment of the elastic hooking means of the present invention.

FIG. 8 illustrates another embodiment of the hooking means of the present invention. In this embodiment, the hooking means are generally indicated with reference numerals 6 and 7. As in the first embodiment, the hooking means 6, 7 have hooks 61, 71 formed at one end and push portions 62, 72 at another end opposite to the hooks 61, 71. Middle portions of the hooking means 6, 7 are located in the channels 13, 14 at two lateral sides of the male connector 10. Pivotal holes 63, 73 are formed near centers of the hooking means 6, 7 for pins 64, 74 to extend through. The pins 64, 74 extend their two ends into side walls of the channels 13, 14 so as to fix the hooking means 6, 7 in the channels 13, 14. The push portions 62, 72 in this embodiment have two inward bent arms 65, 75 elastically pressing against the casing of the male connector 10. Outer surfaces of the push portions 62, 72 are covered with protective jackets 66, 76.

Figure 9A:
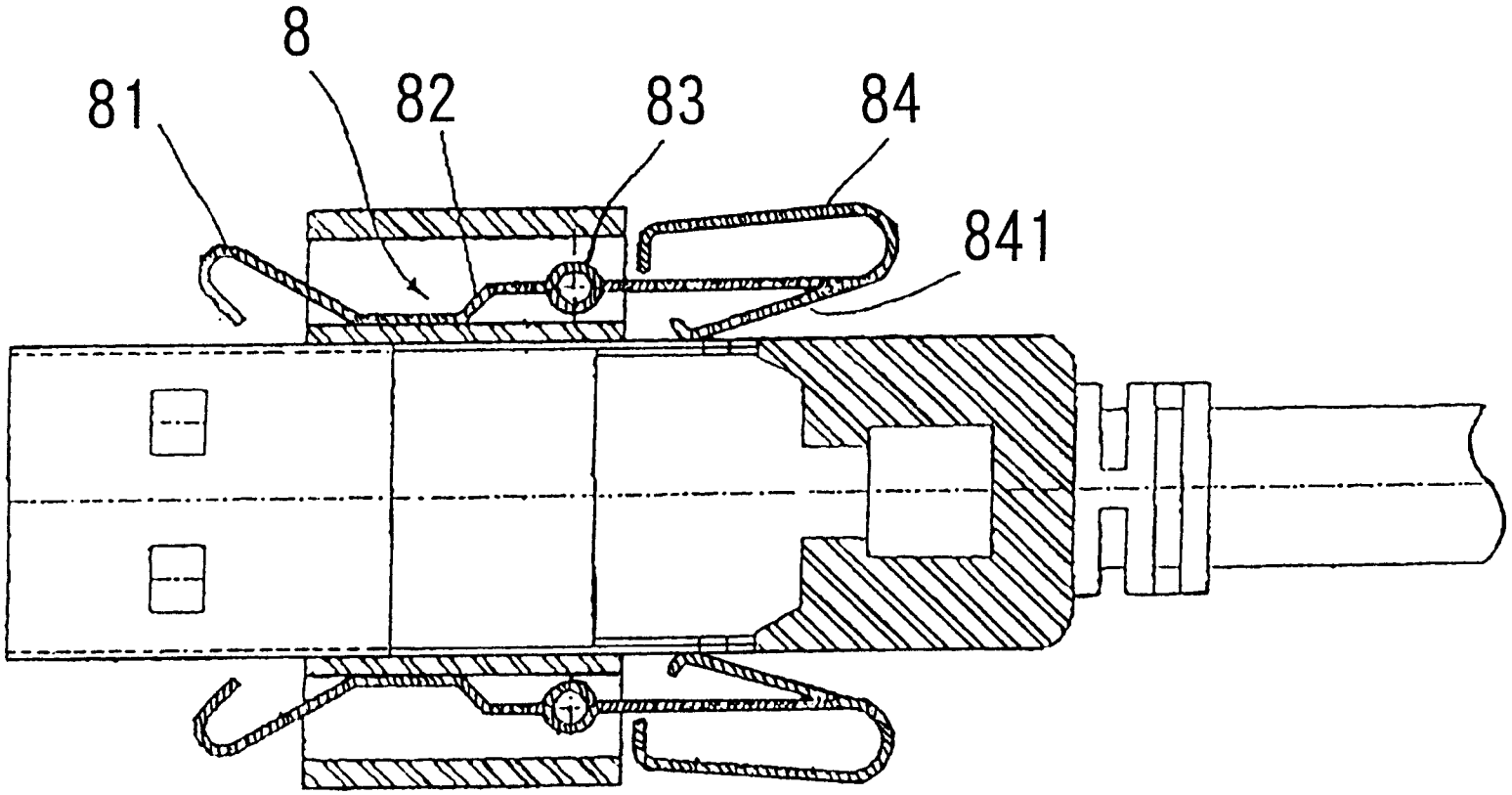
FIGS. 9 and 9B illustrate a further embodiment of the elastic hooking means of the present invention.
Figure 9B:
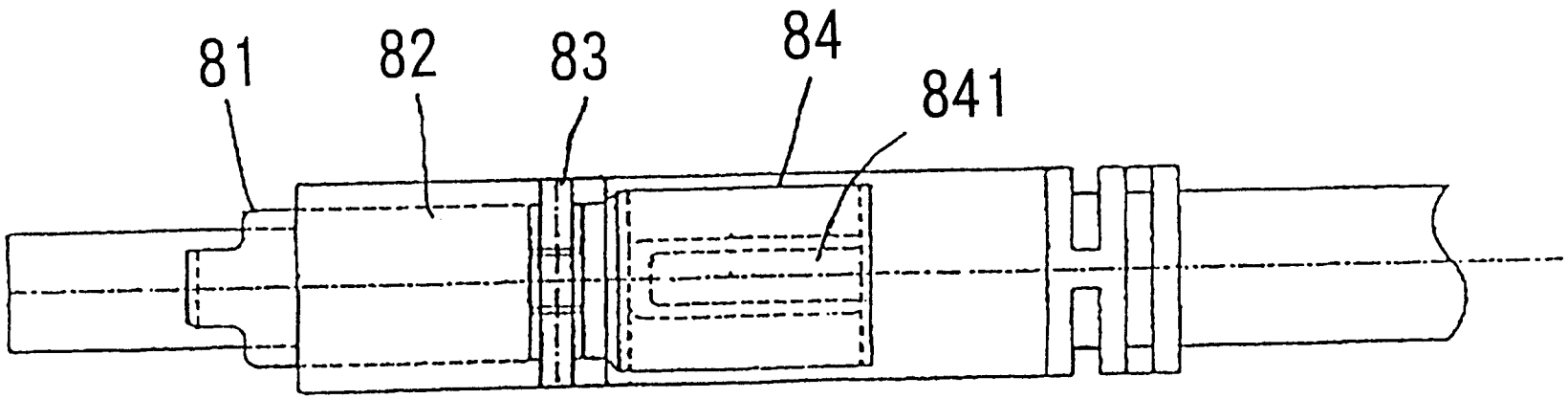

Please now refer to FIG. 9 in which a further embodiment of the hooking means of the present invention is shown. In this embodiment, the hooking means at each side of the male connector is generally indicated with reference numeral 8. The hooking means 8 includes a front hook portion 81 which extends backward to form a main body 82 in the form of a flat plate. A pivotal connecting hole 83 is formed on the main body 82 near a middle portion thereof for an insertion pin (not shown) to thread through. Two outer ends of the insertion pin extend into side walls of the male connector, so that the hooking means 8 is pivotally connected to one side of the male connector. Another end of the hooking means 8 opposite to the front hook portion 81 extends upward and then forward again to form a push portion 84. An elastic plate 841 extends from a bottom part of the push portion 84 to press a free end of the elastic plate 841 against the side wall of the male connector. The elastic hooking means 8 according to this embodiment also form a convenient retaining means to firmly connect the male connector to the female connector.

With the above arrangements, the universal serial bus connector of the present invention may actually achieve firm and tight connection of the male connector to the female connector to enable good signal transmission. What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A universal serial bus connector assembly comprising:

a) at least one female connector having a female casing bounding an opening into which a male connector is inserted, the opening having at least two opposite side portions;

b) a retaining tab extending outwardly from the female casing at each of the at least two opposite side portions;

c) at least one male connector having a male casing with a portion inserted into the opening bounded by the female casing, the at least one male connector having at least two opposite side portions, a channel formed on each of the at least two opposite side portions, each channel having an inner side wall with a through hole therein, and a recess in each of the at least two opposite side portions;

d) a hooking device located in each of the channels, each hooking device having a first end with a hook formed thereon, a second end with a push portion formed thereon, a middle portion having an L-shaped mounting hook extending therefrom and engaging the associated through hole and a retaining tab extending therefrom and engaging the associated recess to attach the hooking device to the male casing, and inclined elastic pressing arms extending from the middle portion and contacting a surface of the associated channel so as to bias the hook toward the male casing, such that the hooks engage the tabs to hold the male and female connectors engaged, and such that movement of the push portions toward the male casing causes the hooks to move outwardly away from the male casing to thereby disengage from the tabs to enable the male and female connectors to be disengaged.

2. The universal serial bus connector of claim 1, further comprising at least two female connectors contained within a single casing and at least two male connectors, each male connector engaging one female connector.

3. The universal serial bus connector of claim 2, wherein the at least two female connectors are designed in a vertical one above the other configuration and wherein the tabs for each female connector extend laterally from opposite lateral sides of each female connector.

4. The universal serial bus connector of claim 2, wherein the at least two female connectors are disposed in a lateral, side-by-side configuration and wherein the tabs for each female connector extend outwardly from opposite top and bottom sides of each female connector.

5. A universal serial bus connector assembly comprising:

a) at least one female connector having a female casing bounding an opening into which a male connector is inserted, the opening having at least two opposite side portions;

b) a retaining tab extending outwardly from the female casing at each of the at least two opposite side portions;

c) at least one male connector having a male casing with a portion inserted into the opening bounded by the female casing, the at least one male connector having at least two opposite side portions, a channel formed on each of the at least two opposite side portions;

d) a hooking device located in each of the channels, each hooking device having a first end with a hook formed thereon, a second end with a push portion formed thereon, a middle portion having a pivot hole therethrough;

e) a pivot pin extending through each of the pivot holes and into the male casing to pivotally attach the hooking device to the male casing; and f) inclined elastic pressing arms extending from the hooking device and contacting the male casing so as to bias the hook toward the male casing, such that the hooks engage the tabs to hold the male and female connectors engaged, and such that movement of the push portions toward the male casing causes the hooks to move outwardly away from the male casing to thereby disengage from the tabs to enable the male and female connectors to be disengaged.

6. The universal serial bus connector of claim 5, further comprising at least two female connectors contained within a single casing and at least two male connectors, each male connector engaging one female connector.

7. The universal serial bus connector of claim 6, wherein the at least two female connectors are disposed in a vertical one above the other configuration and wherein the tabs for each female connector extend laterally from opposite lateral sides of each female connector.

8. The universal serial bus connector of claim 6, wherein the at least two female connectors are disposed in a lateral, side-by-side configuration and wherein the tabs for each female connector extend outwardly from opposite top and bottom sides of each female connector.

* * * * *